US006212792B1

(12) United States Patent
Bier

(10) Patent No.: US 6,212,792 B1
(45) Date of Patent: Apr. 10, 2001

(54) BASKET AND METHOD OF USE

(76) Inventor: Rosalie J. Bier, 4450 Vieja Dr., Santa Barbara, CA (US) 93110

( * ) Notice: Subject to any disclaimer, the term of this patent is extended or adjusted under 35 U.S.C. 154(b) by 0 days.

(21) Appl. No.: 09/347,352

(22) Filed: Jul. 1, 1999

(51) Int. Cl.[7] ..... F26B 5/08

(52) U.S. Cl. ..... 34/315; 34/318; 34/321; 34/322; 34/58; 34/90; 34/109; 34/600; 34/602; 34/604; 34/187

(58) Field of Search ..... 34/312, 313, 315, 34/317, 318, 58, 425, 600, 602, 603, 604, 184, 187, 321, 90, 104, 109, 202, 204, 322

(56) References Cited

U.S. PATENT DOCUMENTS

| | | | | |
|---|---|---|---|---|
| 2,150,620 | | 3/1939 | Frost . | |
| 2,784,500 | * | 3/1957 | Beaumont | 34/602 |
| 3,017,758 | * | 1/1962 | Havenstock et al. | 34/600 |
| 3,651,580 | * | 3/1972 | Meyer | 34/602 |
| 3,696,521 | * | 10/1972 | Hubbard | 34/602 |
| 3,769,819 | | 11/1973 | Contreras . | |
| 4,007,546 | * | 2/1977 | Sauer | 34/602 |
| 4,109,397 | | 8/1978 | Daily . | |
| 4,388,739 | | 6/1983 | Martinon et al. . | |
| 5,276,979 | | 1/1994 | Gordon, Sr. . | |
| 5,743,025 | | 4/1998 | Jordan, Jr. . | |

* cited by examiner

*Primary Examiner*—Pamela Wilson
(74) *Attorney, Agent, or Firm*—Leo F. Costello

(57) ABSTRACT

A basket or dryer liner that has the usual basket shape, i.e, generally cylindrical, but is resiliently compressible or deformable along multiple axes for reshaping into irregular shapes. It has perforate bottom wall and side walls and an open top and is generally symmetrical about x, y, and z axes that are orthogonal to each other. The basket may be manually compressed alone these axes and then allowed to return to its normal shape when released. Thus, it has a non-compressed, relaxed state wherein it has maximum exterior dimensions and can stand-alone and serve the normal functions of a basket. The basket also has a compressed condition wherein at least certain of the dimensions of the basket are less than said maximum dimensions so that it can be fitted into a dryer, allowed to expand, and serve as a dryer liner. Wet clothes and other items can then be placed in the basket through the dryer opening in the normal manner. After the dryer is operated and the items have been dried, the basket is again compressed and pulled out of the dryer with its load of the dried items. The basket with these items is then able to stand-alone to enable the dried items to be removed. The user thus need bend down only once to remove all of the clothes in the basket instead of many times for each item of clothing. The basket can be compressed and stored in the dryer or other small spaces.

33 Claims, 8 Drawing Sheets

BASKET AND METHOD OF USE

FIELD

The present invention pertains to a basket and to a method of use thereof and more particularly to a basket that has special utility as a removable liner for a clothes dryer but also has more general utility in the normal manner of a basket.

BACKGROUND

Although the modern clothes drying machine has greatly facilitated the task of drying clothes, the use of the drying machine either at home or in a Laundromat can still be tiring, especially for anyone having a bad back. Compared to using a washing machine, the use of a dryer requires deep bending. That is, washing machines are usually top-loaded and unloaded, requiring minimal bending of the user. In contrast, a clothes dryer is generally side-loaded and unloaded from a down-low position, requiring deep bending by the user.

A typical clothes-washing and drying scenario may involve removing the wet clothes from the washing machine, usually in clumps, since the wet clothes stick together, and tossing these clumps into the dryer. As such, for a given drying load, although there might be dozens of individual pieces of clothing, there are usually only a few wet of clumps of laundry, requiring only a few tosses down into the dryer. Moreover, since the clumps are wet and somewhat heavy as compared with dried clothes, the clumps are relatively easy literally to throw into the dryer. The loading activity may be accomplished from nearly erect positions. Very little bending is required.

Although it might seem easier, the task of removing the dried clothes from the dryer may be more tedious and tiring, especially if one has back problems. After drying, the clothes typically do not stick together anymore, so they ordinarily must be removed from the dryer one-by-one. Further, it may be preferred to remove them one-by-one anyway in order to shake and smooth them out to minimize wrinkling. Because of the down-low position of a dryer opening, therefore, the user must bend over deeply each time he or she reaches into the dryer to retrieve a dried item, then stand up to hang or lay out the dried item, then bend over again, then stand up, and repeat this action for as many times as there are individual clothes items in the dryer, a task very hard on one's back, especially with a large load of clothes in the machine.

Furthermore, using a dryer involves several other tasks that require bending over or squatting down to reach into the dryer. Oftentimes, static electricity causes one or more small items, like a stocking or handkerchief, to stick to the drum wall, sometimes on the upper wall so that it is difficult to see without stooping down and peering up into the dryer. Also, the drying process creates lint that is captured in a lint basket that must periodically be emptied by bending down to remove and replace it.

Insofar as applicant is aware, no solution has been provided to ease the tasks described above. Baskets have been provided to contain shoes to-be-dried and prevent them from tumbling around in the dryer, such as disclosed in the U.S. Pat. Nos. 4,109,397; 5,276,979; and 5,743,025. Although perhaps useful for shoes, these patented devices would not play a useful role in the typical washing-drying scenario of loading wet clothes to-be-dried into a dryer and retrieving them after drying.

SUMMARY

A basket or dryer liner is provided that has the usual basket shape, i.e., generally cylindrical, but is resiliently compressible or deformable along multiple axes for reshaping into irregular shapes. It has perforate bottom wall and side walls and an open top and is generally symmetrical about x, y, and z axes that are orthogonal to each other. The basket may be manually compressed along these axes and then allowed to return to its normal shape when released. Thus, it has a non-compressed, relaxed state wherein it has maximum exterior dimensions and can stand-alone and serve the normal functions of a basket. The basket also has a compressed condition wherein at least certain of the dimensions of the basket are less than said maximum dimensions so that it can be fitted into a dryer, allowed to expand, and serve as a dryer liner. Wet clothes and other items can then be placed in the basket through the dryer opening in the normal manner. After the dryer is operated and the items have been dried, the basket is again compressed and pulled out of the dryer with its load of the dried items. The basket with these items is then able to stand-alone to enable the dried items to be removed. The user thus need bend down only once to remove all of the clothes in the basket instead of many times for each item of clothing. The basket can be compressed and stored in the dryer or other small spaces.

An object of the present invention is to facilitate the use of a clothes dryer.

Another object is alleviate the bodily strains especially back pains, associated with removing items from a clothes dryer.

An additional object is to provide a basket or other receptacle that can be removably fitted in a drying machine as a liner therein to contain clothes and other items to be dried and that enables all of the items to be removed as a group from the machine after they have been dried.

Yet another object is to provide a basket that is primarily intended to be used in the interior of a clothes dryer to contain clothes while they are being dried and to facilitate removal of the dried clothes from the dryer and that is made to be deformed or reshaped to make such dryer use possible.

A further object is to provide a resiliently compressible basket that has a normally expanded conventional basket shape wherein it is able to stand-alone on a counter, table, or other flat support surface and receive items to be contained therein or from which items can be retrieved, and a variety of compressed shapes that are achieved by manually and selectively compressing the basket along one or more multiple axes, whereby the basket can be fitted through openings or spaces that are smaller than the dimensions of the basket when in its normally expanded shape.

Yet another object is to provide a basket that can be inserted into a dryer for holding items to-be-dried therein that is heat-resistant to the extent necessary for the temperatures inside a dryer, that is perforate for passage of air therethrough and yet not so coarse as to allow small items of clothing to pass therethrough, that captures lint that is generated during the drying process, and that is resistant to corrosion that could be caused by contact with wet items to-be-dried.

An additional object is to facilitate removing all items from a dryer after a drying cycle, especially small items of clothing, such as handkerchiefs and socks, and thereby to avoid missing some items and possibly losing them, especially in a commercial Laundromat setting.

Another object is to provide a laundry basket that can also be used for carrying dirty laundry prior to being washed, for receiving wet laundry directly from the washing machine, and for carrying other items unrelated to laundry.

Still an additional object is to utilize the flexible, compressible characteristics of a basket to facilitate its storage in small spaces.

A further object is to provide a basket that can be resiliently compressed and snugly fitted inside the drum of a clothes dryer both during a drying cycle to hold clothes being dried but also when the dryer is not in use thereby to be stored in the dryer.

A still further object is to provide a basket of the type described that is economical to manufacture, that is of simple and durable construction, that is easy to clean and otherwise maintain.

These and other objects, features and advantages of the present invention will become apparent upon reference to the following description, accompanying drawings, and appended claims.

DETAILED DESCRIPTION

Figure 1:
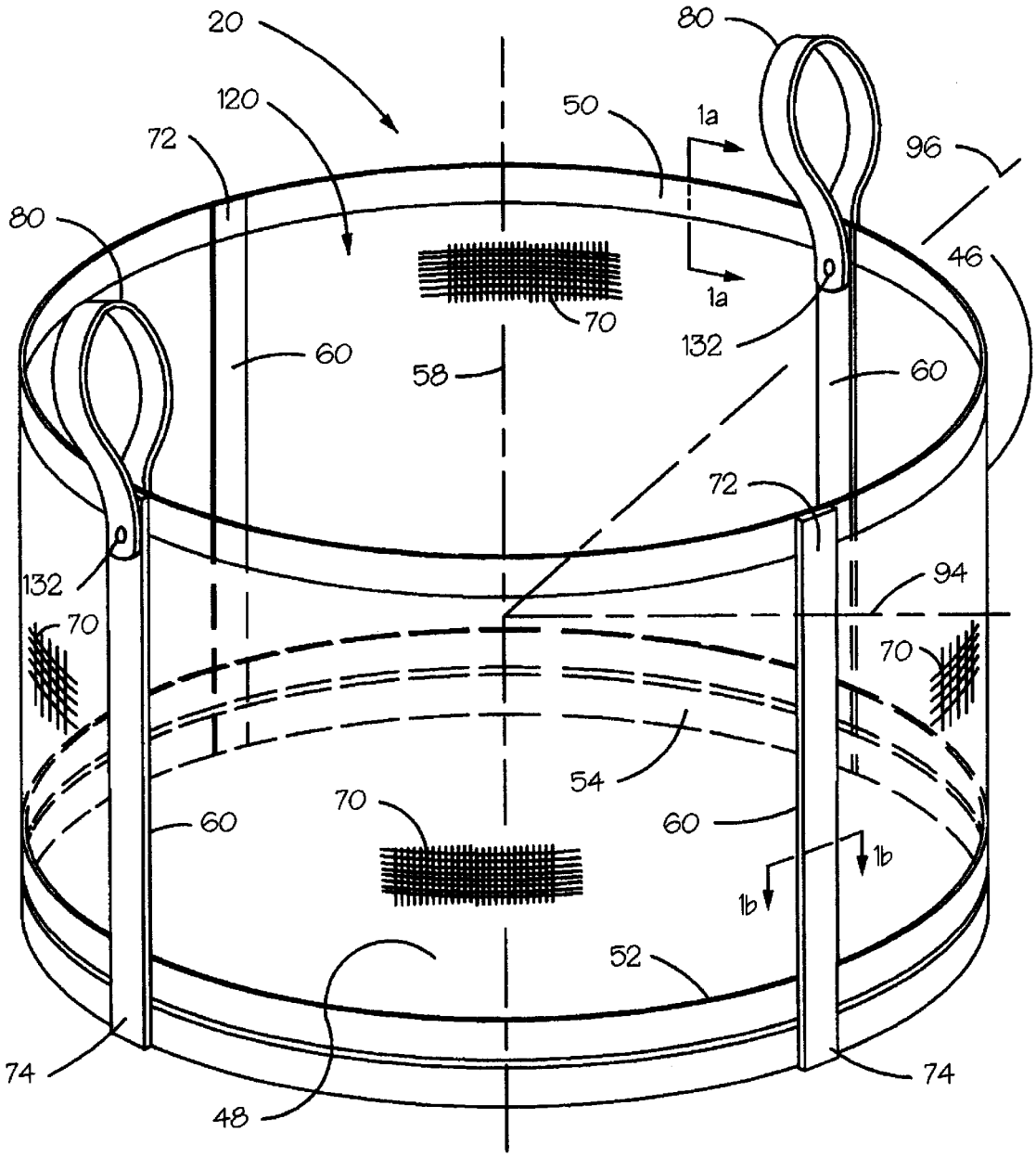
FIG. 1 is an isometric view of a basket incorporating the principles of the present invention showing the basket in its normal fully expanded condition, but with only fragments of the cover being shown, and with three different axes that are referred to in the description also being indicated.

A basket constructed in accordance with the principles of the present invention is generally indicated by the numeral 20 in the drawings. Although dictionary definitions of the word "basket" may suggest a container made of interwoven twigs, rushes, or thin strips of wood, no particular material is to be implied by the use of the word "basket" in the present invention, although characteristics of the material and preferred materials for the subject basket will be subsequently described. The word "basket" has been chosen as the title primarily to describe its shape and because it fits its principle and intended applications, but terms such as "container", "receptacle", "bin" or "hamper" or even "liner" could be applied to the device. The subject basket is not like a typical basket, however, in that the subject basket is resiliently compressible along multiple axes as will be described.

Figure 7:
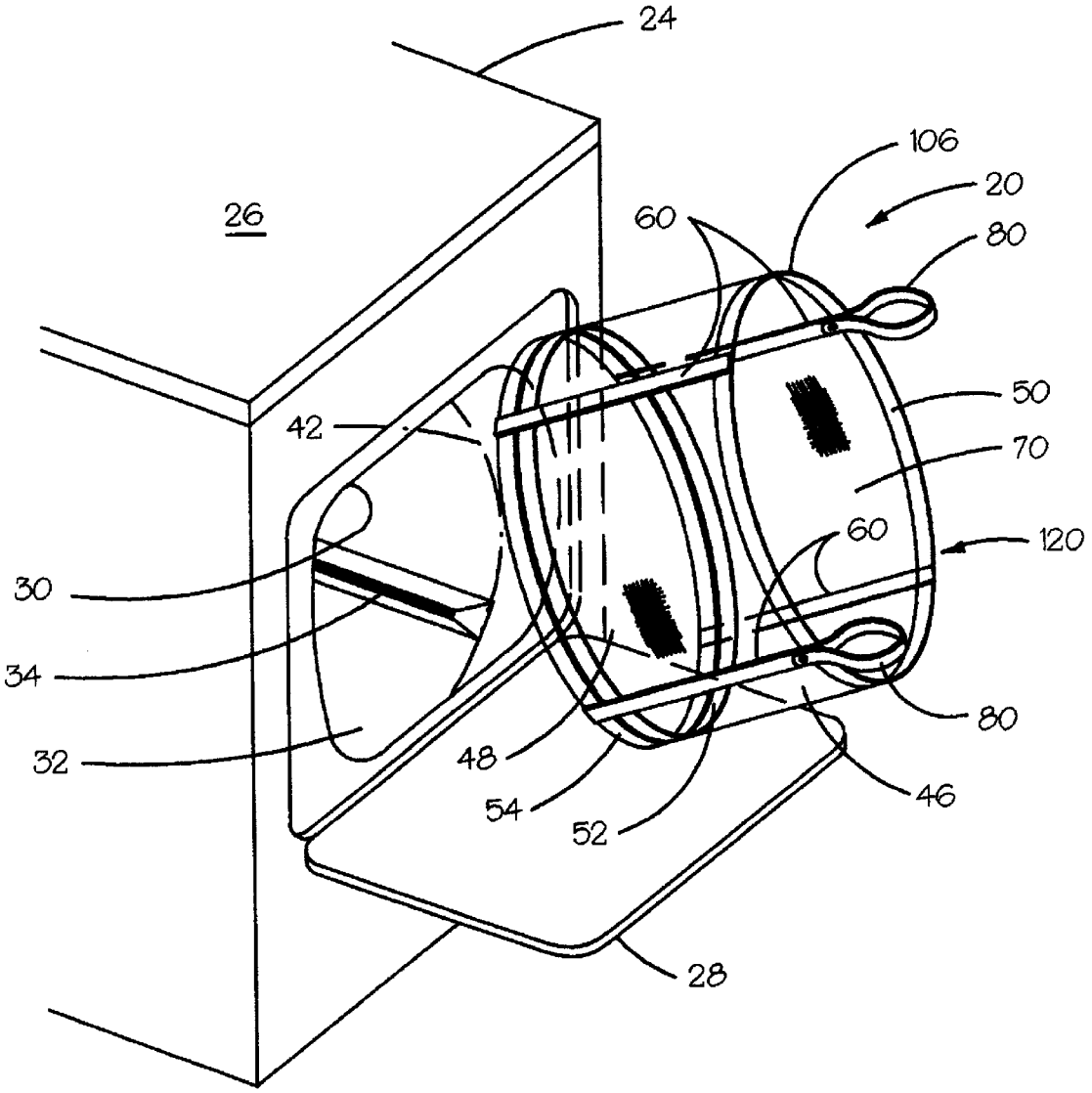
FIG. 7 is an isometric view of a clothes dryer with its door open to show the interior of the dryer and with the basket of the present invention being shown in a position outside the dryer just before it is compressed in a manner similar to that shown in FIGS. 5 or 6, or both, in order to be fitted into the dryer.

Since the subject basket 20 is intended primarily for use with a clothes drying machine or dryer, such a dryer is generally shown in FIGS. 7–10 and identified generally by the number 24, the parts of which will now be briefly referred to for convenient subsequent reference. The dryer thus has a top surface 26, a door 28, an opening 30, and a rotatable drum 32 that has radially inwardly projecting tumbler fins 34. The principles of the basket of the present invention are applicable to a wide variety of the clothes dryers that are on the market and thus are not to be limited to any particular brand of dryer. Some dryers have front doors, as 28, that hinge about a horizontal axis, but others, not shown, have doors that hinge about a vertical axis. In addition, the openings, as 30, of some dryers are generally rectangular, as shown in FIGS. 7–10, but other dryers have circular openings, arch-shaped openings, or other shapes. Furthermore, the dimensions of the drum, fins, and openings may differ, but these variations are readily accommodated by the subject basket. In fact, because of the resiliently compressible characteristics of the subject basket, it is particularly suited for dryers having these variable parameters. Nevertheless, for convenient subsequent reference, the opening 30 of the dryer 24 shown in FIGS. 7–10 is generally rectangular having a vertical dimension indicated by the number 38 and a horizontal dimension indicated by the number 40. Moreover, as shown in FIG. 7, it will be convenient to refer to the fact that the fins of the drum are tangent to an imaginary circle indicated by the number 42 in FIG. 7.

Although as previously stated, the invention is not limited to any particular dimensions or brands of dryer, it will be helpful in explaining various relationships involved with the present invention to provided certain specific dimensions of one model of dryer, as shown in FIGS. 7–10. What is generally illustrated in these figures is a 1996 Kenmore dryer, model 66902690. This dryer has a door opening 30 with a vertical dimension 38 of approximately 12.25" and a horizontal dimension 40 of approximately 20.5". The maximum inside diameter of the drum 32 as measured between the bases of diametrically opposed fins 34 is approximately 26.5", and the minimum inside diameter of the drum, as measured by the diameter of the imaginary circle 42 is approximately 18.5 inches. The length of the drum, that is, its axial length, is about 23.5". Each fin 34 of this Kenmore model has a length measured axially of the drum of about 4" and a width or radial dimension of about 4".

The basket 20 (FIGS. 1–4) has an annular side wall 46, preferably cylindrical in its normal expanded condition, and a flat bottom wall 48. These walls are formed by vertically spaced, top and bottom resiliently flexible, hoops or annular members 50, 52 and 54, respectively, interconnected by elongated resiliently flexible, staves or stays 60; and a flexible, perforate cover 70 surrounding the hoops and the staves on the sides and bottom of the basket. The basket also includes handles 80. In the prototype of the preferred embodiment shown in the drawings, the hoops, staves, and handles are all made from the same material namely, elongated thin, resiliently flexible, strips of a hard, plastic material having the other characteristics described herein. Flat or round stock may be employed, although flat stock is used in the preferred embodiment. The material of the hoops, staves and handles must be able to withstand, without deterioration, the conditions inside of a dryer 24 while drying wet clothes, that is, a resistance to the dryer temperatures generated and to rust. Also, the material must remain at temperatures that are not too hot to touch after a drying cycle. Alternatively, elongated pieces of a flexible, round or flat springy metal could be used, provided that the metal is heat and rust resistant to the dryer environment, as might be provided by a coating of a suitable plastic on the metal.

For the prototype of the preferred embodiment, suitable strips of a plastic stock material for the hoops 50, 52, and 54; the staves 60; and the handles 80 were obtained from Orchard Supply Hardware of San Jose, Calif. having stores, inter alia, in Goleta, Calif. and Hanford, Calif., under the trademark "Polyhinge" and as their model No. 140505. This material is a hard white plastic believed to be polyethylene and is currently sold by Orchard Supply in twenty-five foot rolls having a width of about 1½ inches and a thickness of about 3/32 inch. The strip as sold for use as a plastic hinge is a molded strip of two. side-by-side, but spaced, hinge mounting flanges, each of about 3/32 inch thickness and about 5/8 inch in width, joined by a thinner hinging web of about 1/32 inch thick and about ¼ inch in width.

For the subject prototype (FIGS. 1–4), the top hoop 50 and the staves 60 were formed by cutting off appropriate lengths of just one of the hinge mounting flanges, i.e., cutting the purchased strip lengthwise approximately in half but without the web. The bottom hoops 52 and 54 of the prototype were formed by the Polyhinge strip just as it sold, i.e., without lengthwise cutting. Thus, the hinge mounting flanges joined by the web form the bottom hoops and may be thought of as just one bottom hoop that is wider than the top hoop. In the case of the hoops, the cut ends were joined by suitable fasteners such as fasteners like staples, although a suitable adhesive or fusion could be employed. It is to be understood that the hoops 50, 52, 54; the staves 60; and the handles 80 were made from the described Polyhinge material primarily because of the convenience and availability of this stock material. The hoops, staves and handles and their formation into the basket framework may be accomplished in several other ways, involving molding, extrusion, gluing, fusing and other techniques that are well known in the art and are not part of the present invention.

The preferred flat stock material for the top hoop 50 and the staves 60 has a rectangular cross section (FIGS. 1*a* and 1*b*) providing a thickness dimension 84 and width dimension 86. Although the dimensions used in the preferred embodiment are not limiting to the invention, the thickness dimension 84 is approximately 3/32" and the width dimension is approximately 5/8", dimensions which follow from the above described Polyhinge material used for the prototype. It also follows that the dual bottom hoop or hoops 52, 54 has a width of about 1½ inches, a hoop thickness of about 3/32 inch, and a web interconnecting the hoops of about 3/32 inch thickness.

The endless hoops 50, 52 and 54 (FIGS. 1–4) are all of the same diameter and are interconnected by the staves 60 in a coaxial relationship about a longitudinal axis 58 of the basket. The dual or wider bottom hoop or hoops 52, 54 is used to provide the basket 20 with a firm base so that it can be free-standing on the floor, or the top surface 26 of the dryer 24, or a countertop. That is, there need not be two interconnected bottom hoops 52 and 54, since one bottom hoop will suffice if it has the strength and resiliently flexible characteristics of the dual hoops. As stated above, two bottom hoops may be combined into one hoop having a width dimension approximately twice that of the width 86 of the top hoop 50. In other words, the main purpose of a wider base is to allow the basket to stand alone as a container of laundry or other articles in the normal manner of a basket. It is here to be noted that the basket has been described as having "top" and "bottom" hoops, but it will be understood that the basket is used in various orientations so that these "top" and "bottom" references arc merely for descriptive convenience and do not limit the orientation of the basket.

Figure 6:
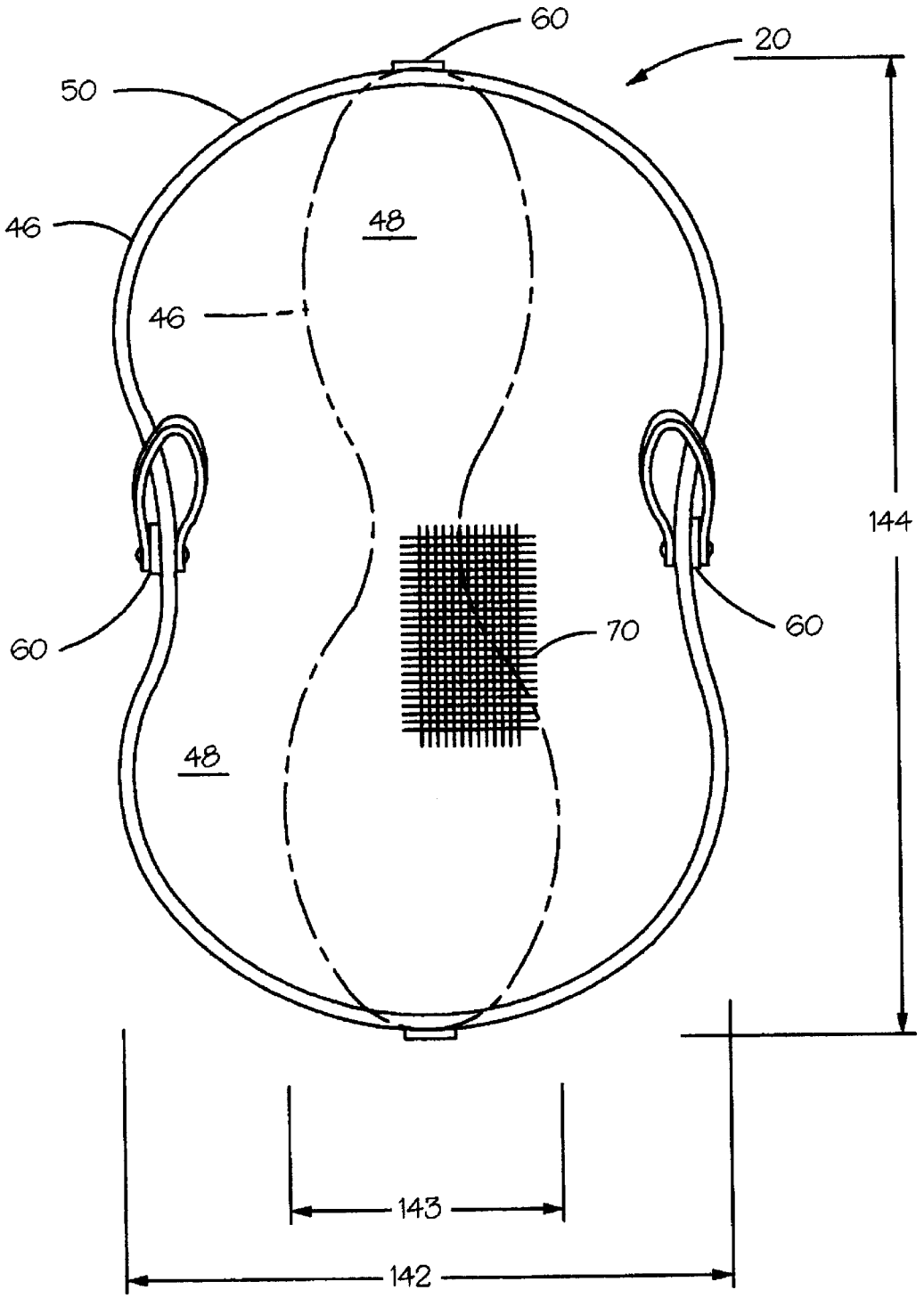
FIG. 6 is a top plan of the basket on the same scale as FIG. 2 but showing the basket partially transversely compressed in one of its irregular shapes in full lines and substantially fully transversely compressed in another of its irregular shapes in dashed lines.

The hoops 50, 52, 54 are resiliently compressible from their normally relaxed, generally circular configuration, as shown in FIGS. 1–4, into various irregular shapes such as the approximately elliptical shape shown in full lines in FIG. 6 and the approximately figure eight configuration shown in dashed lines in FIG. 6. Thus, the hoops have such resilient flexibility that they may be compressed to the position where the opposite sides of the hoops may be brought into actual contact. Thus, the basket can be compressed throughout substantially its entire width or transverse dimension. The resilient characteristic of the hoops is such that once the compressive force is applied and released in the intended use of the basket, the hoops return to their substantially normal circular configurations as shown in FIGS. 1–4.

The staves 70 (FIGS. 1–4) are of uniform length and are resiliently flexible or bendable lengthwise of each stave. The staves have upper ends 72 that are integrally connected to the top hoop 50 in equally spaced relation around the top hoop and lower ends 74 that are likewise integrally connected to the bottom hoops 52 and 54 in equally circumferentially spaced relation about the bottom hoops. As shown in the preferred embodiment, the staves are preferably integrally fused to the top and bottom hoops so that there is a rigid, non-pivotal connection between the staves and the hoops. Alternatively, the connection between the staves and the hoops might be with fasteners which may be fixed or pivotal while retaining the overall resilient compressibility of the basket along various axes as described herein. However, such pivotal connection might add complexity and cost to the basket, without an offsetting improvement in function; in fact, the rigid connections shown are believed to be less expensive, less complicated, and more effective for the purposes of the invention. Also, although four staves are shown in the preferred embodiment, additional staves could be used although they are not believed to be necessary. Furthermore, it may be possible to use only three staves while accomplishing the essential functions of the basket. In the preferred embodiment, however, four staves are believed to be the most optimum number.

Figure 1A:
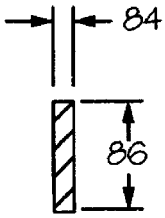
FIG. 1*a* is an enlarged cross section taken on line 1*a*—1*a* in FIG. 1.
Figure 1B:
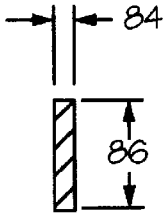
FIG. 1*b* is an enlarged cross section taken on line 1*b*—*b* in FIG. 1.

With the hoops 50, 52 and 54 (FIGS. 1–4) interconnected by the staves 60, as above described, the basket 20 takes on its generally cylindrical configuration. Thus in its normal condition, the basket has a maximum outside diameter or transverse dimension 90 (FIG. 2), a maximum height or length 92 (FIG. 2), and is symmetrical about three axes, namely, an "x" axis 94, a "y" axis 96, and the "y" axis 58, each of which is shown in FIG. 1 and which are at right angles to each other in the usual understanding of a three dimensional object.

Figure 1C:
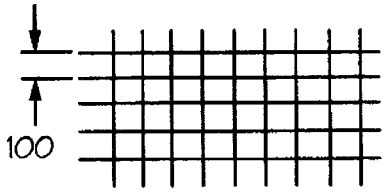
FIG. 1*c* is an enlarged fragment of the cover used in the basket shown in FIG. 1.
Figure 2:
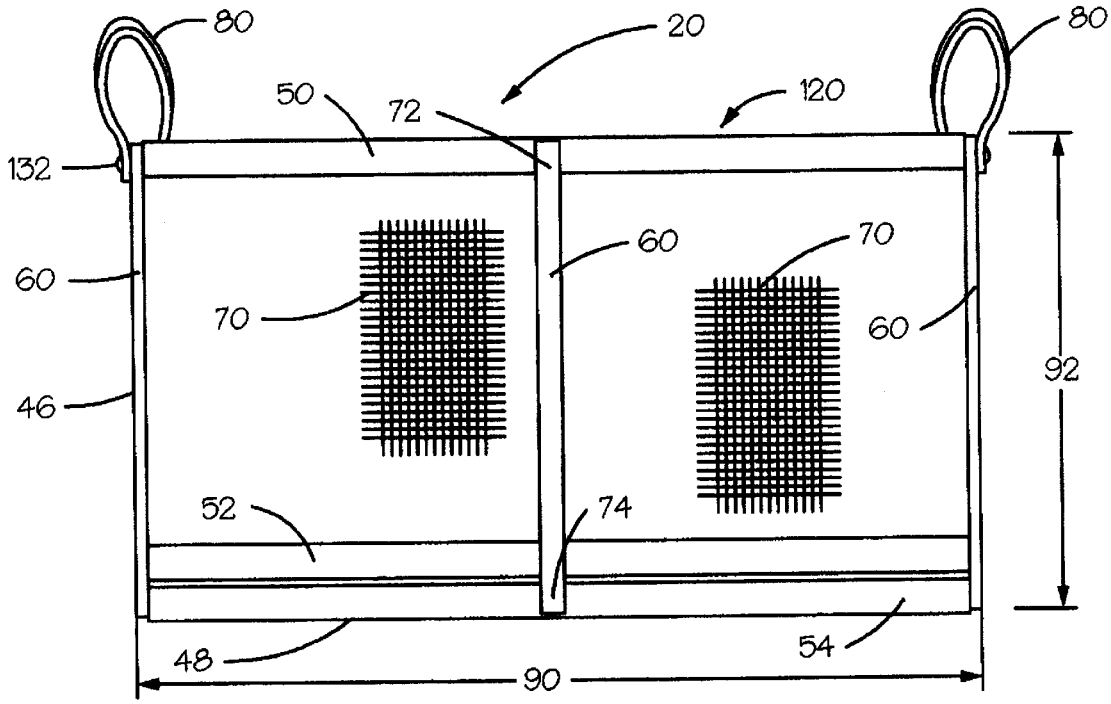
FIG. 2 is a side elevation of the basket as shown in FIG. 1 but on a scale reduced from that of FIG. 1.
Figure 3:
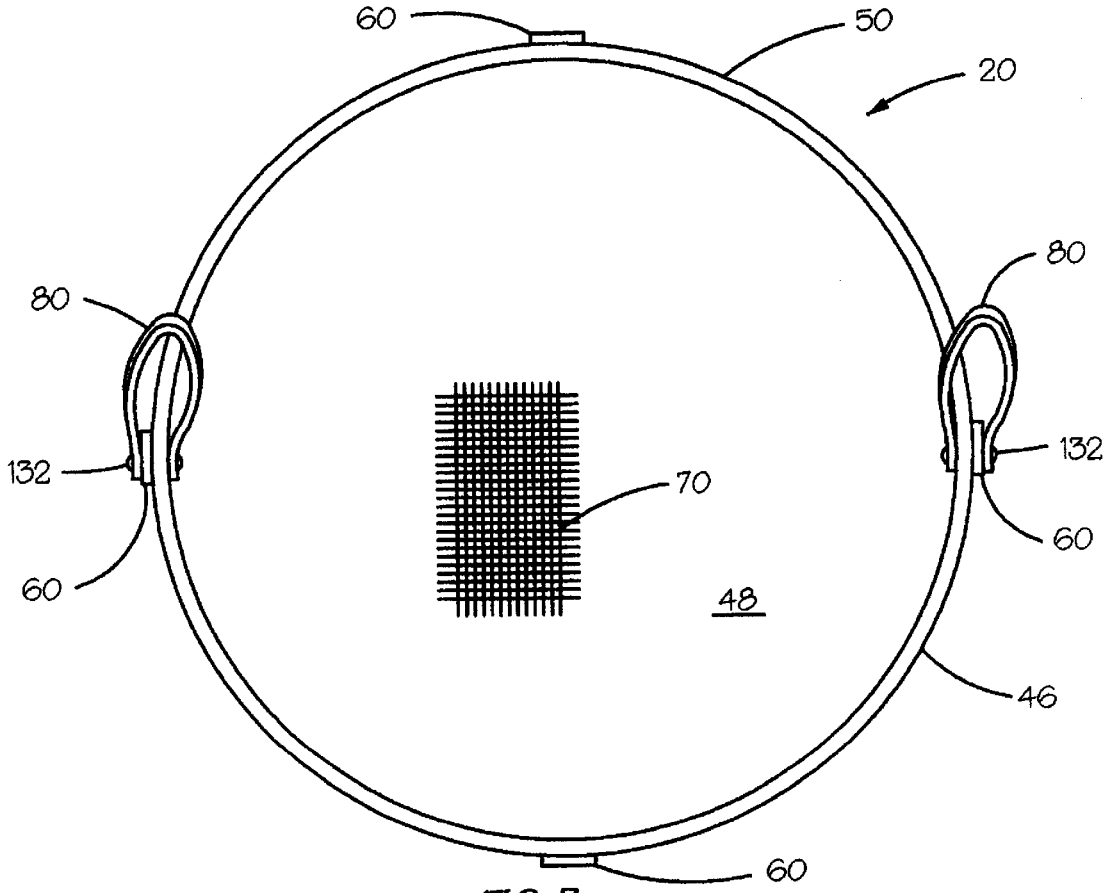
FIG. 3 is a top plan view of the basket as shown in FIG. 2.
Figure 4:
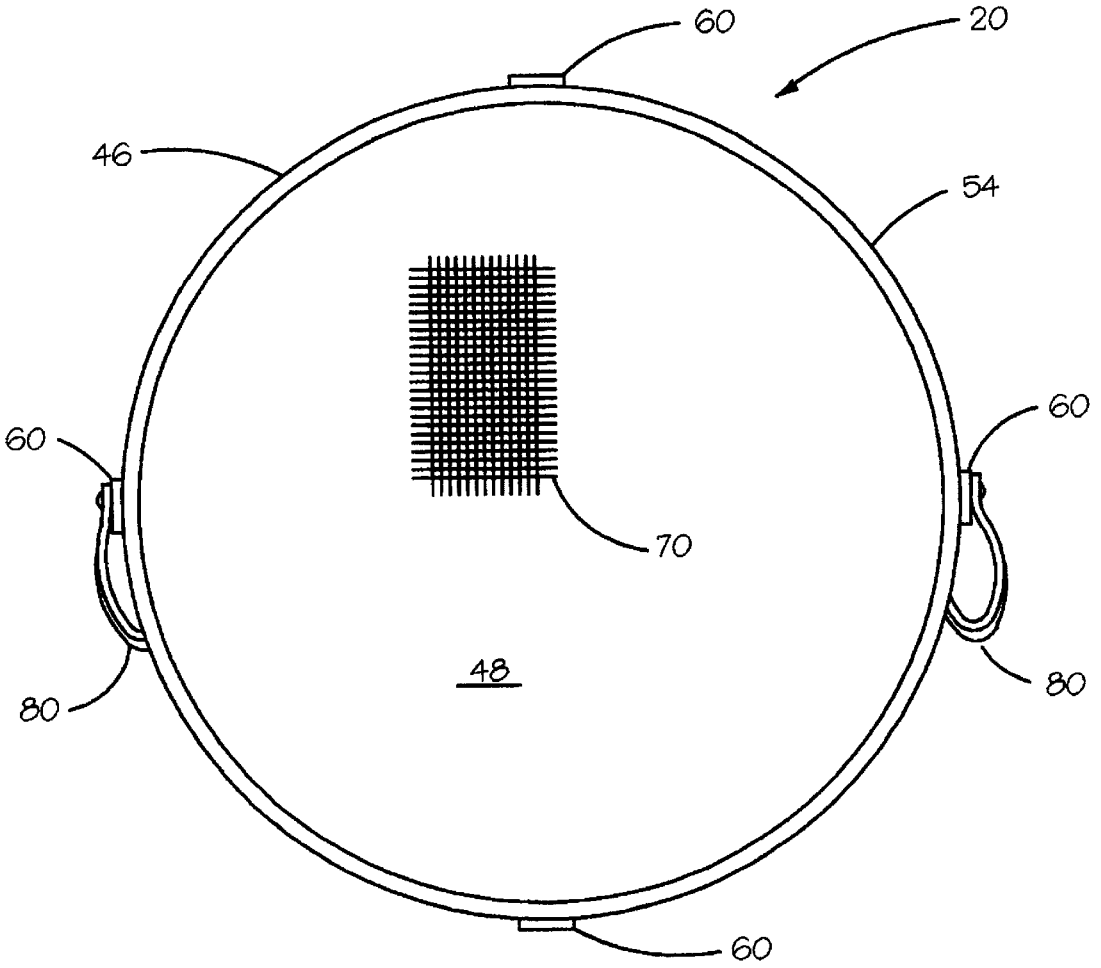
FIG. 4 is a bottom plan view of the basket as shown in FIG. 2.

The cover 70 (FIGS. 1–4 and 7) is made of a thin, lightweight, heat and snag-resistent fine mesh, such as nylon net. The gauge or size 100 (FIG. 1*c*) of the openings in the net is large enough to allow air to pass through the cover when the basket 20 is in a closed dryer 24 that is operating to dry a load of clothes but small enough to restrict lint from passing through the cover. The screen size that is used in a lint trap, not shown but well known, for a dryer is very suitable for the cover. Thus, in the preferred embodiment of the cover, the mesh is less than about a millimeter or 1/32" square. Suitable nylon net from which to make the cover may be purchased at Craft Village at 187 Turnpike Road in Santa Barbara, Calif.

The cover 70 (FIGS. 1–4 and 7) forms the cylindrical side wall 46 circumscribing the hoops 50, 52 and 54 and the staves 70, and the flat bottom wall 48 of the basket extending across the bottom hoop 54. Furthermore, the cover has an upper hem 106 (FIG. 10) folded over the top hoop 50 and stitched in place. The bottom edges of the side and bottom walls of the cover are also stitched together so as to secure the cover to the hoops and the staves. The cover extends around only the side and bottom walls of the basket thereby leaving an upper opening 120 for the basket.

The looped handles 80 (FIGS. 1–4) are preferably pivotally attached by pins 132 at the junctures of two diametrically opposite staves 70 and the top hoop 50. These handles are thus moveable within limited arcs to facilitate handling of the basket. Alternatively, however, the handles could be integrally molded to the upper ends 72 of the staves and to the top hoop. Also, four equally spaced handles could be employed if desired.

Having described the construction of the basket 20 (FIGS. 1–4), the resilient compressibility of the basket will now be described in more detail. As previously described, when the basket is in its relaxed condition, as shown in FIGS. 1–4, it has a maximum diameter or transverse dimension 90 and a maximum height or length dimension 92. These are also referred to as the normal dimensions of the basket or the normal condition of the basket. In this normal condition, the hoops 50, 52 and 54, and the staves 70 have sufficient rigidity and strength to allow the basket to stand alone when sitting on a support surface, such as the top surface 26 of the clothes dryer 24 or on another counter or table or the floor, even though the staves might remain partially flexed when not returning to an exactly straight condition after the basket is axially compressed. In this condition, the basket may serve its normal function as a basket.

The basket 20 (FIGS. 5 and 6) may be compressed along any one or all of the x, y or z axes 94, 58, or 96. If the basket is axially compressed along the y axis 58, it may take on configurations such as shown in full and dashed lines in FIG. 5, wherein the staves 70 are flexed to allow such axial compression. The basket may be compressed less than its full length or height 140, as shown in full lines in FIG. 5, and indicated by the numeral 140, or substantially its full length or height wherein the top and bottom hoops are brought into closely spaced relation to each other, as shown in dashed lines in FIG. 5 and indicated by the numeral 141. The compressed height dimension 140 or 141 of the basket is of course less than its normal height 92.

If the basket 20 is compressed transversely along the x or z axes 94 or 96, the basket may take on the generally elliptical or figure eight configurations shown in full and dashed lines in FIG. 6 wherein the hoops 50, 52 and 54 are flexed inwardly toward each other at diametrically opposed portions and flexed outwardly relative to each other at other diametrically opposed portions. Thus, the basket may be transversely compressed into generally elliptical configurations such as shown in full lines in FIG. 6 and indicated by the numeral 142; into more closely figure eight configurations such as shown in dashed lines in FIG. 6 and indicated by the numeral 143, and even into a figure eight configuration wherein opposed sides of a hoop touch each other, a position that is not shown. The compressed width 142 or 143 of the basket is less than its normal width or diameter 90 but the compressed width 144 may be greater than its normal width or diameter 90, unless the basket is compressed simultaneously along the x and z axes 94 and 96. Furthermore, the top hoop 50 may be compressed while the bottom hoops 52, 54 are not, and vice versa.

Figure 5:
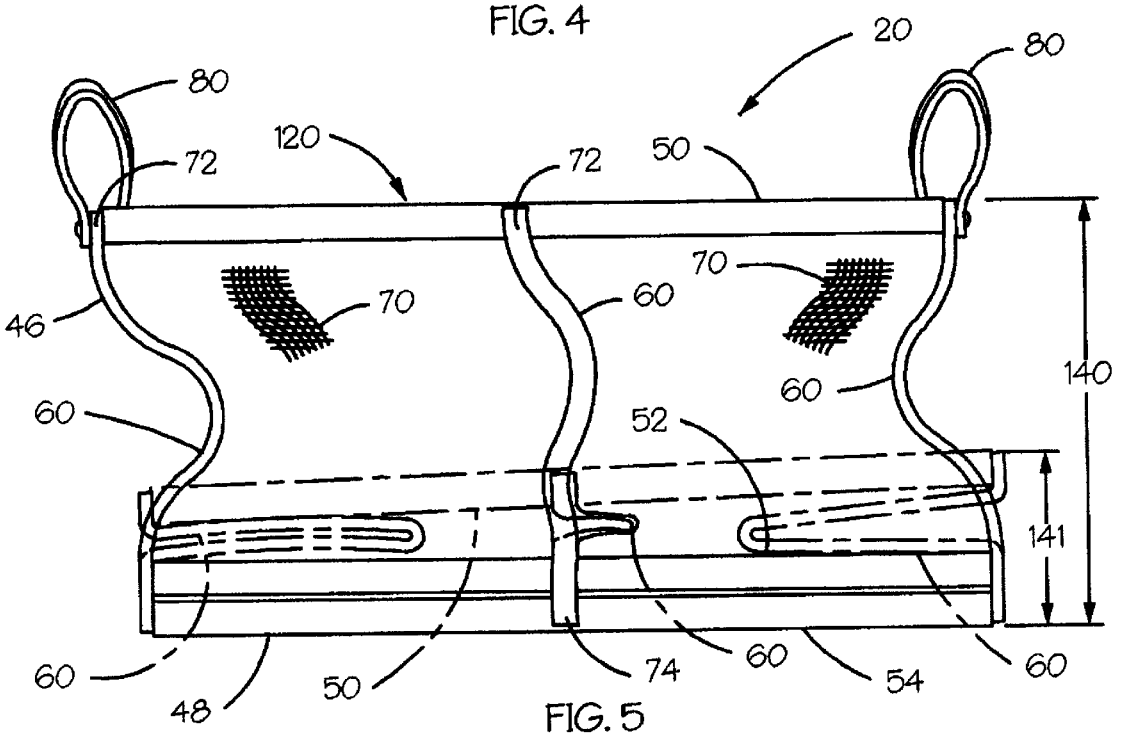
FIG. 5 is a side elevation of the basket on the same scale as FIG. 2 but showing the basket partially axially compressed in one of its irregular shapes in full lines and substantially fully axially compressed in another of its irregular shapes in dashed lines.

Thus, although not shown, the basket 20 can be both axially and transversely compressed or deformed at the same time along multiple axes 58, 94, 96, so that it may simultaneously take on the configurations of FIGS. 5 and 6 together. Moreover, many other irregular configurations can be achieved merely by applying manual pressure to various sides or ends of the basket to enable compression of the basket along any one or all of the three axes referred to above. In this regard, it is to be understood that the x and z axes are not fixed locations for compression of the basket but are merely representative of an infinite number of locations transversely of the side wall where the basket may be transversely compressed. If the compressive force is applied for an extended period of time, for example for a day, the hoops and staves may not return as fully to their fully expanded conditions, or not as quickly. Even so, if they were to return only to positions such as shown in full lines in FIGS. 5 and 6, the basket would still be functional as a container and still could be compressed for the purposes described herein. Subjecting the basket to the heat of the dryer 24 in the intended use of the basket, may help to restore the memory to the hoops and staves so as to cause the basket to return more closely to its maximum, fully expanded condition. It should also be noted that the extent of compression in any direction depends on how full the basket is, but for the laundry applications described herein, the basket is either partially filled to allow the necessary compression or is at least not filled so tightly as to preclude the necessary compression.

OPERATION AND METHOD OF USE

The basket 20 of the present invention is particularly suited for use as a dryer liner basket or liner, and for this purpose, reference is again made to the clothes dryer 24 as shown in FIGS. 7–10. Prior to describing the use of the basket, it is assumed that a load of wet laundry is about to be transferred from a washing machine, not shown, into the clothes dryer 24. Prior to making this transfer, the basket 20 is inserted in the dryer and thus FIG. 7 shows the basket in its normal expanded condition as it might be manually held just outside of the opening 40 of the dryer prior to compression and insertion into the dryer.

The basket 20 (FIGS. 7–10) is then manually compressed, deformed or reshaped along whatever axis or axes 58, 94, and or 96 that is necessary to fit the basket through the particular opening 30 of the dryer 24. In the example given above, the normal height of the basket is approximately 18", whereas the horizontal dimension 40 of the opening is 20.5". Therefore, no axial compression of the basket is necessary to fit it through the opening 30. However, the normal diameter of the preferred embodiment of the basket is 26", whereas the vertical dimension 38 of the opening is 12.25". Accordingly, the basket is manually transversely compressed from its normal diameter of about 26" to less than an overall transverse dimension 142, or 143, slightly less than 12.25".

Figure 8:
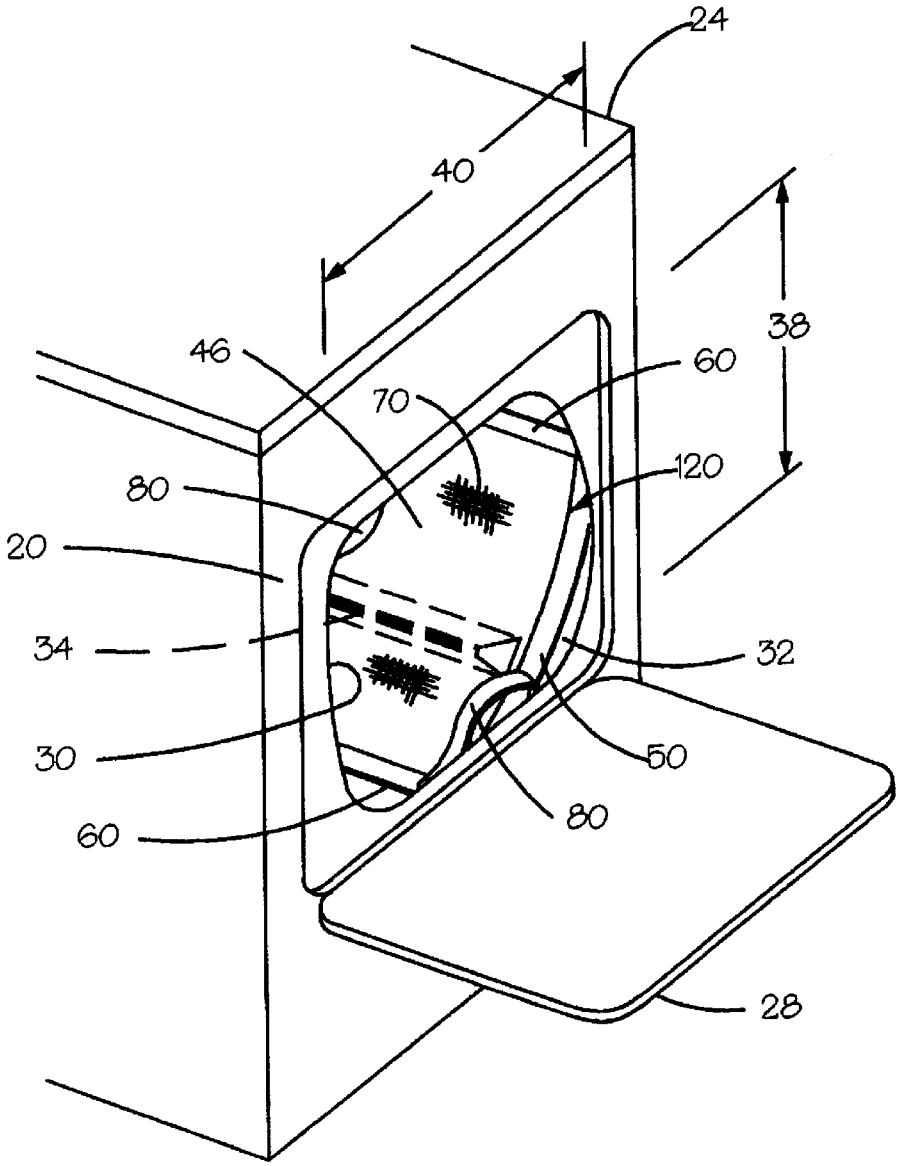
FIG. 8 is a view similar to FIG. 7 but showing the basket fitted into and lining the inside of the dryer, ready to receive laundry to be dried and also showing how the basket may be stored in the dryer.

While holding the basket 20 manually compressed, it may be squeezed through the opening until it is entirely within the dryer 24 and specifically within the drum 32. The basket is then orientated so that its main or y axis 58 is coaxial with the drum. Then the basket is allowed to expand into engagement with the fins 34 as shown in FIG. 8 and with the opening 120 adjacent to the opening 30 of the dryer and thus facing outwardly of the dryer. Since the diameter of the imaginary circle 42 in this example of a dryer 24 is approximately 18.5", the normal diameter 90 of the basket being 26", the basket will be slightly resiliently compressed by its engagement with the fins so that the basket is snugly held within the dryer.

Thereafter, the load of clothes, usually coming out of the washing machine in several clumps since the wet clothes tend to stick together, is tossed by the operator into the dryer 24 and thus into the basket 20 now lining the drum 32. It will be apparent that the basket confines all of the wet laundry inside the basket since the side and bottom walls 46 and 48 of the basket preclude the laundry from escaping at the sides or back. Moreover when the door 28 is closed, the proximity of the top hoop 50 to the front wall of the dryer precludes escape of clothes at the front of the dryer. The door is then closed and the drying cycle is begun to dry the clothes.

Figure 9:
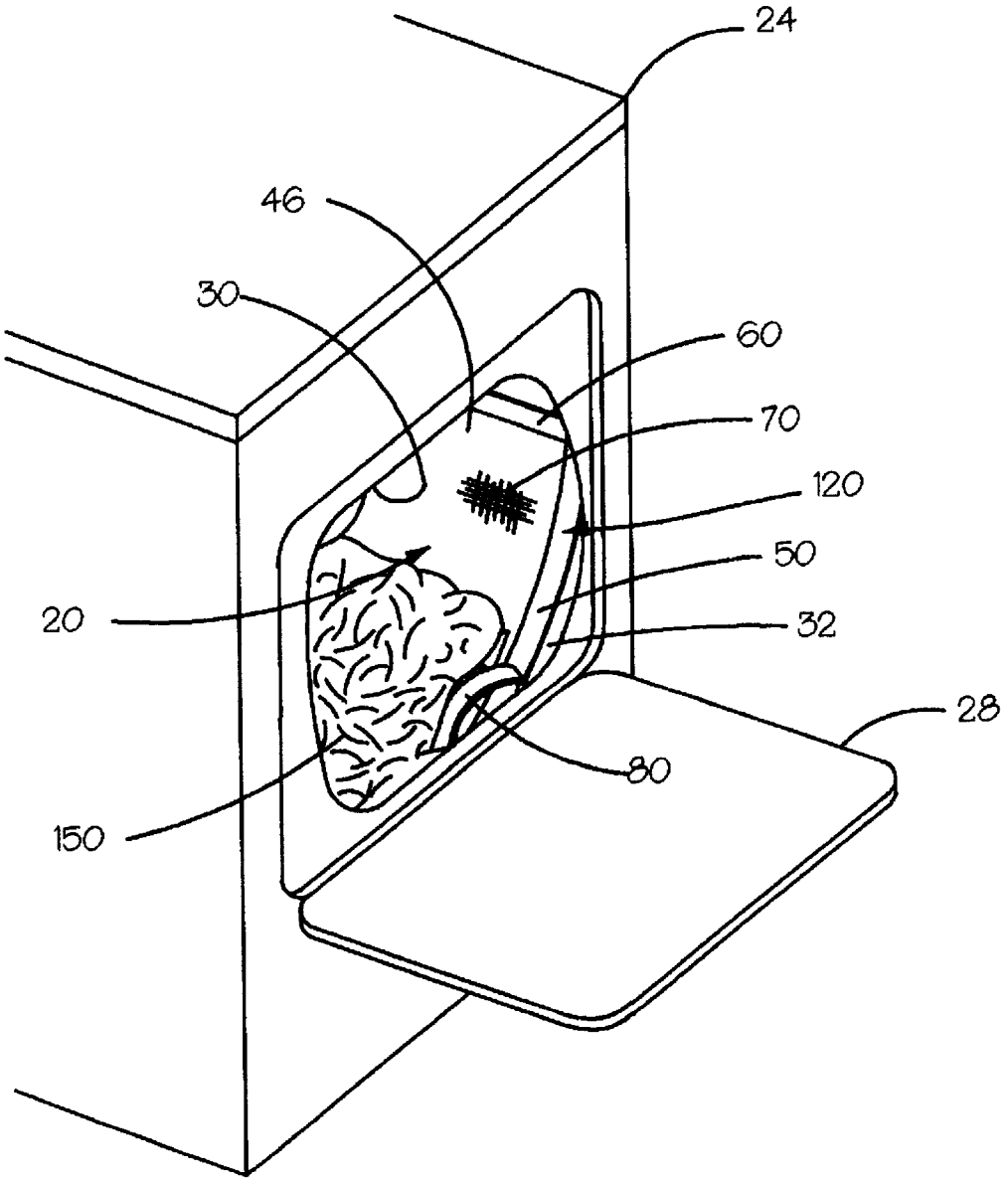
FIG. 9 is a view similar to FIG. 8 but showing laundry items, such as wet clothes, in the basket lining the inside of the dryer.
Figure 10:
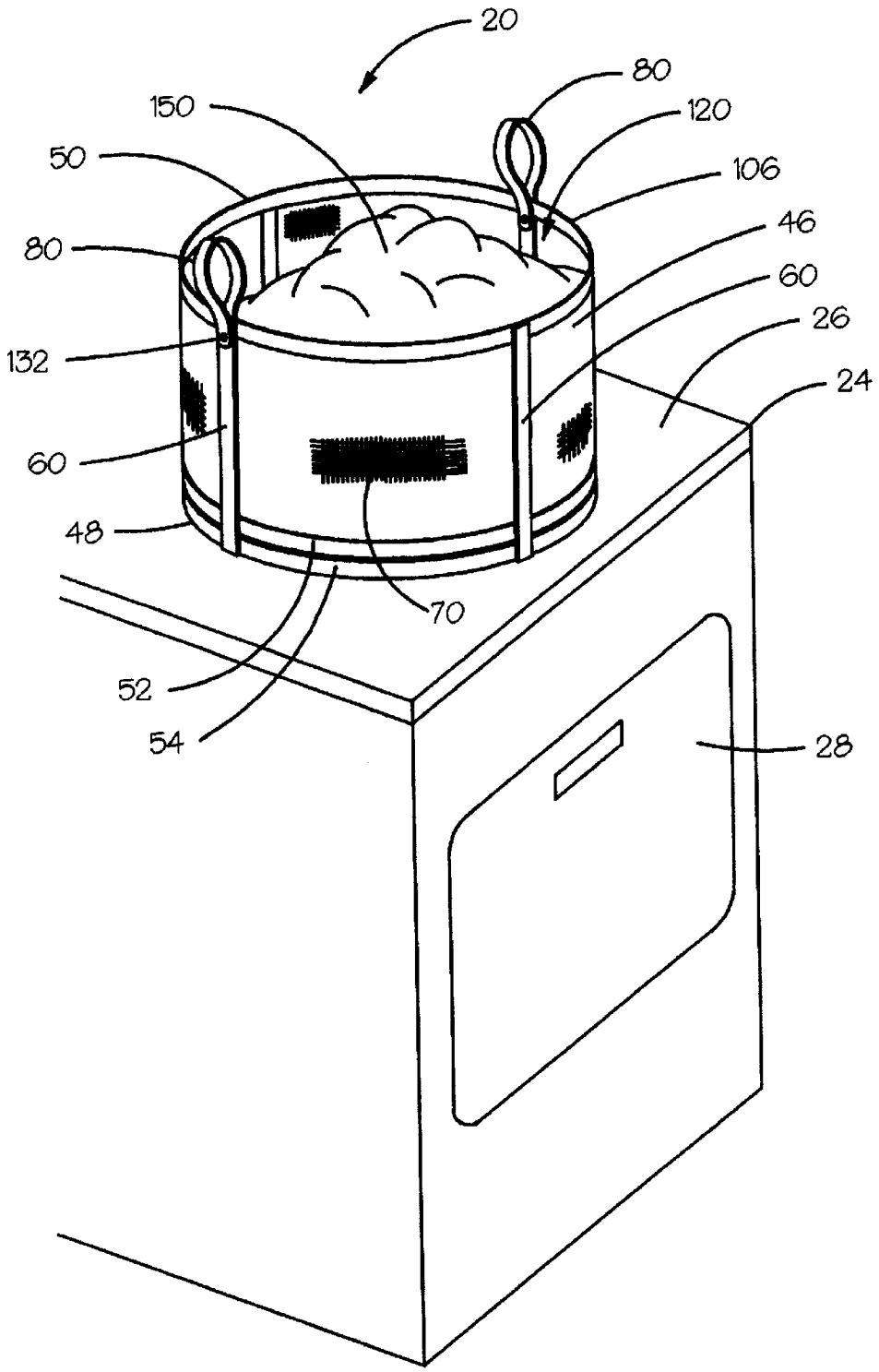
FIG. 10 is a view similar to FIGS. 7–9 but with the dryer door closed and with the basket of the present invention sitting on top of the dryer and filled with a load of clothes that have been dried.

After the drying cycle is completed, the door 28 of the dryer 24 is opened (FIG. 9). The handles 130 are then grasped, and the basket 20 is pulled out of the dryer. For this purpose, it will be necessary to compress, deform or reshape the basket in essentially the same manner as it was compressed to fit in the dryer before the drying process began, even though now carrying the dried clothes. As before, the main axis of compression is either the x and/or z axis 94 or 96 so that by compressing the basket along an x and/or a z axis, it is made narrower than the vertical dimension 38 of the opening 30 whereby the basket and its contents of dry clothes 150 may be removed from the dryer. Thereafter, as shown in FIG. 10, the basket and its contents may be placed on top of the dryer. Thus, instead of having to remove each element of clothing one by one, the entire load can be withdrawn from the dryer all at once. With the basket and dried clothes sitting on top of the dryer, the user can then remove each element of clothing without having to bend over.

When not in use the basket 20 can be conveniently stored in the dryer 24 by compressing the basket and fitting it into the dryer in the same manner as described above but without inserting wet clothes in it. Alternatively, the basket can be compressed and stored in various small spaces, such as between a washer and dryer, under a bed, or the like.

From the foregoing and in summary, it will be understood that the liner basket 20 of the present invention facilitates and enhances use of a clothes dryer 24 particularly by alleviating the bodily strains, especially back pains, associated with removing items from the dryer. The basket is removably fitted in the dryer as a liner therein to contain clothes and other items to be dried and enables all of the items to be removed as a group from the dryer after they have been dried.

The basket 20 is resiliently compressible or deformable so that it can be reshaped from a normally expanded conventional basket shape wherein it is able to stand-alone on a counter, table, floor, or other flat support surface and receive items to be contained therein or from which items can be retrieved, and a variety of compressed shapes that are achieved by manually and selectively compressing the basket along one or more multiple axes, whereby the basket can be fitted through openings or spaces that are smaller than the dimensions of the basket when in its normally expanded shape.

Thus, the basket 20 can be inserted into a dryer 24 for holding items to-be-dried therein, is heat-resistant to the extent necessary for the temperatures inside a dryer, is perforate for passage of air therethrough and yet not so course as to allow small items of clothing to pass therethrough, captures lint that is generated during the drying process, and is resistant to corrosion that could be caused by contact with wet items to-be-dried.

The basket 20 allows all the dried items to be removed from a dryer after a drying cycle, especially small items of clothing, such as handkerchiefs and socks, and thereby avoids missing some items and possibly losing them, an advantage particularly when used in a commercial Laundromat setting. Beyond these special advantages, the basket can also be used for carrying dirty laundry prior to being washed, can receive wet laundry directly from the washing machine, and can carrying other items unrelated to laundry. A special feature of the basket or liner is that its resiliently compressible characteristic enables it to be compressed for storage in the dryer or other small spaces.

Although a preferred embodiment of the present invention has been shown and described, various modifications, substitutions and equivalents may exist without departing from the spirit and scope of the invention. Accordingly, it is to be understood that the present invention has been described by way of illustration and not limitation.

What is claimed is:

1. A liner for the drum of a clothes dryer to hold clothes while they are being dried and to be removed from the dryer with the clothes after they are dried, the dryer having an opening of predetermined size through which the liner and the clothes are passed in entering and exiting the dryer and the drum having a predetermined inside diameter, comprising:

a flexible, perforate annular side wall having an open top and a bottom portion, the side wall circumscribing a first axis for the liner, the liner having a maximum contour greater than said predetermined size of the opening of the dryer in which the liner is used, said contour having a maximum height dimension measured along said first axis and maximum width dimensions measured along second and third axes that are orthogonal to each other and to said first axis; and a flexible, perforate bottom wall connected to and closing the bottom portion of the side wall, the liner being longitudinally and transversely resiliently compressible along said axes into a smaller contour less than both said predetermined size of the opening of the dryer in which the liner is used and said predetermined diameter of the drum of the dryer in which the liner is used.

2. A method of using the liner of claim 1, comprising the steps of:

compressing the liner, inserting the liner into the drum of a clothes dryer, and allowing the liner to expand inside the dryer into an expanded shape into engagement with the dryer drum.

3. A method of using the liner of claim 1, comprising the steps of:

compressing the liner, inserting the liner into the drum of a clothes dryer while compressing the liner sufficiently to fit through the opening of the dryer and into the drum, and allowing the liner to expand inside the dryer into an expanded shape into engagement with the dryer drum.

4. A laundry basket for holding clothes while they are being dried in the drum of a clothes dryer and for removing them from the dryer after they have been dried, the dryer having an opening through which items to-be-dried are placed into and removed from the dryer, the drum having an inside diameter, comprising:

vertically spaced, top and bottom hoops substantially concentric to a longitudinal axis of the basket and each normally having a predetermined outside dimension greater than the diameter of the drum and too large to fit through the dryer opening but being resiliently compressible transversely of the axis into a shape having an outside dimension less than said predetermined outside dimension and small enough to fit through the opening and then expand against the drum;

elongated, normally substantially straight, longitudinally resiliently flexible staves having opposite ends integrally connected to the hoops in circumferentially spaced relation therearound thus interconnecting the hoops, the basket normally having a predetermined height that is too tall to fit through the dryer opening but the staves being resiliently compressible axially of the basket whereby the height of the basket is short enough to fit through the opening; and a flexible, perforate cover enclosing the staves and the bottom hoop.

5. The basket of claim 4, wherein the hoops and the staves have heat-resistant surfaces; and wherein the cover is a fine mesh, heat-resistant netting.

6. The basket of claim 4, wherein the hoops and the staves are resiliently flexible strips of solid plastic.

7. The basket of claim 4, wherein the hoops and the staves are of a springy metal coated with plastic.

8. The basket of claim 4, wherein the hoops and the staves are relatively thin flat strips.

9. The basket of claim 4, wherein the cross-section of the bottom hoop is greater than the cross-section of the top hoop.

10. The basket of claim 4, wherein the staves are integrally, non-pivotally connected to both the top and bottom staves.

11. The basket of claim 4, wherein there is a handle attached to top hoop.

12. The basket of claim 4, wherein the hoops and the staves are made of metal covered with a heat-resistant material.

13. A resiliently compressible laundry basket for removably lining the interior of a clothes dryer, for holding clothes while they are being dried, and for removing dried clothes from the dryer, the dryer having an opening through which clothes are inserted and removed from the dryer, comprising:

a flexible, resiliently compressible, perforate, heat-resistant side wall having a lower end, an open upper end, and circumscribing a longitudinal axis for the basket, the side wall having length and width dimensions and being longitudinally and transversely resiliently compressible throughout substantially the entire length and width dimensions of the basket so that its dimensions can be made small enough to fit through the opening of the dryer and are yet large enough to then press outwardly into engagement with the interior of the dryer;

a flexible, perforate, heat-resistant bottom wall attached to the lower end of the side wall; and handles attached to the side wall.

14. In combination, a clothes dryer having an opening defined by height and width dimensions measured across the opening and having a rotary drum with a predetermined axial length and providing inwardly projecting tumbler fins that are tangent to an imaginary circle whose diameter is greater than either of said dimensions; and a removable liner in the drum composed of spaced, substantially circular, top and bottom resiliently compressible hoops circumscribing an axis for the liner and resiliently bearing outwardly against the fins, each hoop when relaxed having a predetermined outside diameter slightly greater than the diameter of said imaginary circle and greater than at least one transverse dimension of the dryer opening but being resiliently compressible into a variety of non-circular shapes wherein the compressed hoop has a minimum outside dimension less than said predetermined diameter and less than said at least one transverse dimension, whereby the hoops can be compressed, fitted through the dryer opening and then allowed to expand inside of the dryer; elongated, resiliently flexible, normally substantially straight staves having opposite ends integrally connected to the hoops in circumferentially spaced relation therearound thus interconnecting the hoops, the basket thereby having a predetermined length when the staves are normally substantially straight and relaxed, said length being greater than at least one transverse dimension of the dryer opening, the staves being resiliently flexible into a variety of curved shapes wherein the length of the basket is less than said predetermined length and less than said at least one transverse dimension, whereby the basket can be longitudinally compressed, fitted through the dryer opening and then allowed to expand inside of the drum; and a thin, flexible, light-weight, snag-resistant, netting covering the hoops and the staves across the bottom hoop but not across the top hoop whereby the bottom of the liner is closed but top hoop circumscribes an opening for entry and removal of clothes into and from the liner and whereby air can pass through the cover to facilitate drying of the clothes in the liner, the mesh of the netting being fine enough to catch lint generated during the drying cycle; and handles connected to the top hoop at diametrically opposite positions thereof, the hoops, staves, handles, and netting being made of a heat-resistant material capable of resisting the heat in the dryer when it is drying clothes and of a rust-resistant material capable of resisting rust caused by contact with wet clothes.

15. A method of using an annular compressible liner for a clothes dryer, the liner having an expanded shape slightly larger than the interior diameter of the drying drum of the dryer, comprising:

compressing the liner, inserting the liner into the drum of the clothes dryer, and allowing the liner to expand inside the dryer into its expanded shape into engagement with the dryer drum.

16. The method of claim 15, including the additional steps of:

inserting wet clothes into the liner inside the dryer, and operating the dryer to dry the clothes.

17. The method of claim 15, including the additional step of:

removing the liner with the dried clothes therein from the dryer.

18. A method of removing items from a drying machine after they have been dried inside the spinning drum of the dryer, the method using a resiliently compressible perforate basket that can stand-alone and that has an outside dimension that is larger than the opening of the dryer and the inside diameter of the drum but can be compressed to fit through the opening of the dryer, the basket having a closed bottom and an upper opening, comprising the steps of:

compressing the basket;

inserting the compressed basket through the opening of the dryer, allowing the basket to expand inside the dryer;

adjusting the basket so it fits snugly within and against the drum of the dryer and so that its opening is facing out and in alignment with the dryer opening;

passing wet items to-be-dried through the dryer and basket openings into the basket;

operating the dryer to dry the items; and removing the basket containing the dried items by compressing the basket and pulling it through the opening of the dryer.

19. The method of claim 18, including the additional steps of:

standing the basket upright with the dried items therein; and removing the dried items from the basket.

20. The method of claim 19, including the additional step of:

storing the basket in the dryer when not in use.

21. A method of removing items from a drying machine after they have been dried inside the spinning drum of the dryer, the method using the basket of claim 9 that is perforate, that can stand-alone, and that has an outside dimension that is larger than the opening of the dryer and the inside diameter of the drum but can be compressed to fit through the opening of the dryer, the basket having a closed bottom and an upper opening, comprising the steps of:

compressing the basket;

inserting the compressed basket through the opening of the dryer, allowing the basket to expand inside the dryer;

adjusting the basket so it fits snugly within and against the drum of the dryer and so that its opening is facing out and in alignment with the dryer opening;

passing wet items to-be-dried through the dryer and basket openings into the basket;

operating the dryer to dry the items; and removing the basket containing the dried items by compressing the basket and pulling it through the opening of the dryer.

22. A basket for holding clothes while they are being dried in the drum of a clothes dryer and for removing them from the dryer after they have been dried, the dryer having an opening through which items to be dried are placed into and removed from the dryer, the drum having an inside diameter, comprising:

a side wall circumscribing a longitudinal axis of the basket and having upper and lower ends; and a bottom wall at the lower end of the side wall, the basket having height and width dimensions measured respectively lengthwise and transversely of said axis, at least one of said dimensions being larger than the opening of the dryer in which the basket is used, the basket being resiliently compressible in at least said at least one dimension from a larger size, wherein the basket is in a relaxed, substantially fully expanded condition, to smaller sizes, wherein the basket is in a stressed, compressed condition and can be passed through said opening of the dryer and into the drum thereof and thence allowed to expand outwardly against the drum.

23. The basket of claim 22, wherein the walls are perforate.

24. The basket of claim 22, wherein said at least one dimension is the height dimension.

25. The basket of claim 22, wherein said at least one dimension is the width dimension.

26. The basket of claim 22, wherein the basket is resiliently compressible in both its height and width dimensions.

27. A laundry basket for lining the drum of a clothes dryer and holding clothes therein while they are being dried and in which they can be removed from the dryer after they have been dried, comprising:

vertically spaced, top and bottom hoops substantially concentric to a longitudinal axis of the basket, the hoops having predetermined outside dimensions when relaxed but being resiliently compressible transversely of the axis into various irregular shapes with different outside dimensions;

elongated, normally substantially straight, longitudinally resiliently flexible staves having opposite ends connected to the hoops in circumferentially spaced relation therearound thus interconnecting the hoops, the basket normally having a predetermined height but the staves being resiliently compressible axially of the basket whereby the height of the basket can be reduced; and a flexible, perforate cover enclosing the staves and the bottom hoop.

28. The basket of claim 27, wherein the hoops, the staves, and the cover have heat-resistant external surfaces.

29. The basket of claim 27, wherein the basket is made of a plastic material.

30. A laundry basket for holding clothes while they are being dried in the drum of a clothes dryer and for removing them from the dryer after they have been dried, the dryer having an opening through which items to-be-dried are placed into and removed from the dryer, the drum having an inside diameter, comprising:

vertically spaced, top and bottom hoops substantially concentric to a longitudinal axis of the basket and each normally having a predetermined outside dimension greater than the diameter of the drum and too large to fit through the dryer opening but being resiliently compressible transversely of the axis into a shape having an outside dimension less than said predetermined outside dimension and small enough to fit through the opening and then expand against the drum; and elongated, normally substantially straight, longitudinally resiliently flexible staves having opposite ends integrally connected to the hoops in circumferentially spaced relation therearound thus interconnecting the hoops, the basket normally having a predetermined height that is too tall to fit through the dryer opening but the staves being resiliently compressible axially of the basket whereby the height of the basket is short enough to fit through the opening.

31. A combined clothes basket and removable dryer drum liner, comprising:

a flexible, perforate annular side wall having an upper end that is open and a lower end, the side wall circumscribing a first axis for the liner, the liner having a maximum contour, said contour having a maximum height dimension measured along said first axis and maximum width dimensions measured along second and third axes that are orthogonal to each other and to said first axis; and a flexible, perforate bottom wall connected to and closing the lower end of the side wall, the liner being longitudinally and transversely resiliently compressible along said axes into a contour smaller than said maximum contour.

32. A removable clothes dryer liner, comprising:

a flexible, perforate annular side wall having an upper end that is open and a lower end, the side wall circumscribing a first axis for the liner, the liner having a maximum contour greater than the opening of a clothes dryer through which clothes are inserted into and removed from the dryer, said contour having a maximum height dimension measured along said first axis and maximum width dimensions measured along second and third axes that are orthogonal to each other and to said first axis; and a flexible, perforate bottom wall connected to and closing the lower end of the side wall, the liner being longitudinally and transversely resiliently compressible along said axes into a contour smaller than such clothes dryer opening.

33. A clothes basket that also serves as a liner for the drum of a clothes dryer to hold clothes while they are being dried and to be removed from the dryer with the clothes after they are dried, the dryer having an opening of predetermined size through which the liner and the clothes are passed in entering and exiting the dryer and the drum having a predetermined inside diameter, comprising:

a flexible, perforate annular side wall having an upper end that is open and a lower end, the side wall circumscribing a first axis for the liner, the liner having a maximum contour greater than said predetermined size, said contour having a maximum height dimension measured along said first axis and maximum width dimensions measured along second and third axes that are orthogonal to each other and to said first axis; and a flexible, perforate bottom wall connected to and closing the lower end of the side wall, the liner being longitudinally and transversely resiliently compressible along said axes into a smaller contour less than both said predetermined size and diameter.

* * * * *